US011865400B2

(12) United States Patent
Muhic et al.

(10) Patent No.: US 11,865,400 B2
(45) Date of Patent: Jan. 9, 2024

(54) EXERCISE MACHINES HAVING SYNCHRONIZING CLUTCH MECHANISM

(71) Applicant: Life Fitness, LLC, Rosemont, IL (US)

(72) Inventors: Andrew Muhic, Seattle, WA (US); Joseph J. Gajewski, Hoffman Estates, IL (US)

(73) Assignee: Life Fitness, LLC, Rosemont, IL (US)

( * ) Notice: Subject to any disclaimer, the term of this patent is extended or adjusted under 35 U.S.C. 154(b) by 166 days.

(21) Appl. No.: 17/242,882

(22) Filed: Apr. 28, 2021

(65) Prior Publication Data

US 2022/0347515 A1 Nov. 3, 2022

(51) Int. Cl.

| | |
|---|---|
| ***A63B 21/22*** | (2006.01) |
| ***A63B 22/06*** | (2006.01) |
| ***A63B 21/00*** | (2006.01) |

(52) U.S. Cl.

CPC ..... *A63B 21/225* (2013.01); *A63B 21/157* (2013.01); *A63B 22/0605* (2013.01)

(58) Field of Classification Search

CPC ..... A63B 21/157; A63B 21/225; A63B 22/06–2022/0658

See application file for complete search history.

(56) References Cited

U.S. PATENT DOCUMENTS

| | | | | |
|---|---|---|---|---|
| 4,671,396 | A | 6/1987 | Kotamaki | |
| 4,673,177 | A | 6/1987 | Szymski | |
| 6,913,560 | B2 | 7/2005 | Ryan et al. | |
| 7,544,139 | B2 | 6/2009 | Seol | |
| 7,607,370 | B2 | 10/2009 | Day et al. | |
| 7,850,577 | B2 | 12/2010 | Warner et al. | |
| 2007/0023248 | A1 | 2/2007 | Nguyen et al. | |
| 2019/0178313 | A1 | 6/2019 | Wrobel | |
| 2022/0134179 | A1* | 5/2022 | Taylor | A63B 24/0087 482/4 |

* cited by examiner

*Primary Examiner* — Andrew S Lo

(74) *Attorney, Agent, or Firm* — Andrus Intellectual Property Law, LLP

(57) ABSTRACT

An exercise machine has a flywheel, a rotary input member, and a clutch mechanism that is positionable in a freewheel position in which rotation of the rotary input member causes rotation of the flywheel and wherein thereafter ceasing rotation of the rotary input member permits continued rotation of the flywheel. The clutch mechanism is alternately positionable in a direct drive position in which rotation of the rotary input member causes rotation of the flywheel and wherein thereafter ceasing rotation of the rotary input member prevents continued rotation of the flywheel. Advantageously, movement of the clutch mechanism from the freewheel position to the direct drive position is prevented when rotation of the rotary input member is out of synchronization with rotation of the flywheel.

23 Claims, 10 Drawing Sheets

EXERCISE MACHINES HAVING SYNCHRONIZING CLUTCH MECHANISM

FIELD

The present disclosure relates to personal exercise machines, including but not limited to stationary bikes.

BACKGROUND

The following U.S. Patent is incorporated herein by reference.

U.S. Pat. No. 6,913,560 discloses a stationary exercise bicycle having a frame, a resistance member, a drive assembly, a right pedal, a left pedal, a seat, and an adjustable seat mechanism utilizing a rack. Assembly and disassembly of a three-piece crank arm assembly is accomplished without requiring the assembling and disassembling of the entire drive assembly. The stationary exercise bicycle also provides a variety of users with an optimum seat position and with a convenient latch mechanism to adjust the position of the seat.

SUMMARY

This Summary is provided to introduce a selection of concepts that are further described herein below in the Detailed Description. This Summary is not intended to identify key or essential features of the claimed subject matter, nor is it intended to be used as an aid in limiting the scope of the claimed subject matter.

An exercise machine comprises a flywheel, a rotary input member, a user input member for performing an exercise motion which causes rotation of the rotary input member, and a clutch mechanism that is positionable in a freewheel position in which rotation of the rotary input member causes rotation of the flywheel and wherein thereafter ceasing rotation of the rotary input member permits continued rotation of the flywheel. The clutch mechanism is alternately positionable in a direct drive position in which rotation of the rotary input member causes rotation of the flywheel and wherein thereafter ceasing rotation of the rotary input member prevents continued rotation of the flywheel. Advantageously, movement of the clutch mechanism from the freewheel position to the direct drive position is prevented when rotation of the rotary input member is out of synchronization with rotation of the flywheel.

BRIEF DESCRIPTION OF THE DRAWINGS

The present disclosure includes the following drawing figures.

DETAILED DESCRIPTION

During research and development in the field of exercise machines having flywheels, including but not limited to stationary bikes, the present inventor realized it would be desirable and/or advantageous to provide embodiments that are selectively operable in different states, including (A) a freewheel state in which rotation of a rotary input member causes rotation of the flywheel and wherein thereafter ceasing rotation of the rotary input member permits continued rotation of the flywheel, and (B) alternately in a direct drive state in which rotation of the rotary input member causes rotation of the flywheel and wherein thereafter ceasing rotation of the rotary input member prevents continued rotation of the flywheel. The present inventor further determined it would be desirable and/or advantageous to configure such exercise machines such that switching from the freewheel state to the direct drive state is prevented if the rotary input member is out of synchronization with rotation of the flywheel. The inventor determined that such a configuration would advantageously avoid a sudden, potentially shocking mechanical gear change that could cause damage to the machine and/or startle the user. The present disclosure is based upon these realizations.

Figure 1:
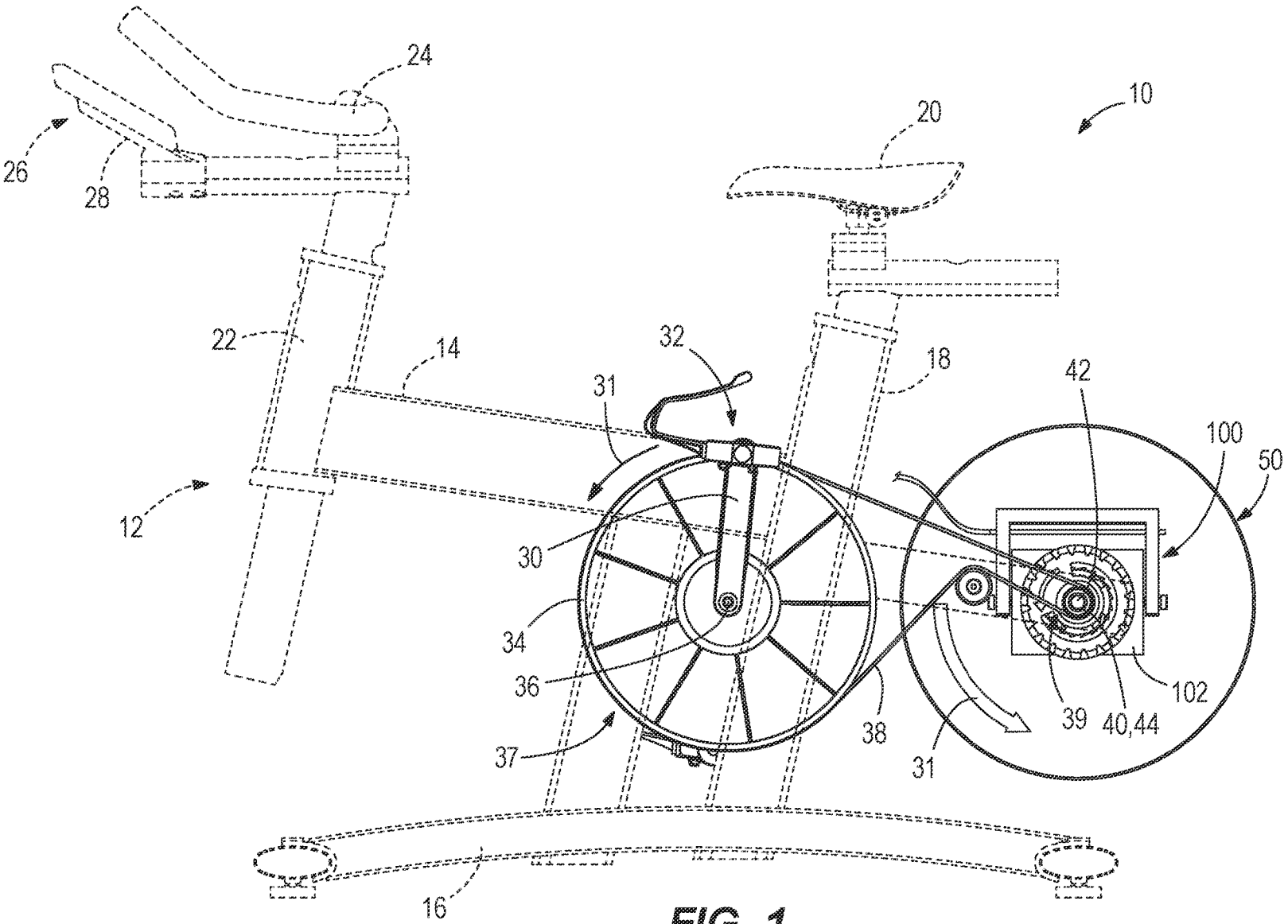
FIG. 1 is a side view of an exercise bike having pedals for performing a cycling exercise motion and a novel clutch mechanism that operably connects the pedals to a flywheel.
Figure 2:
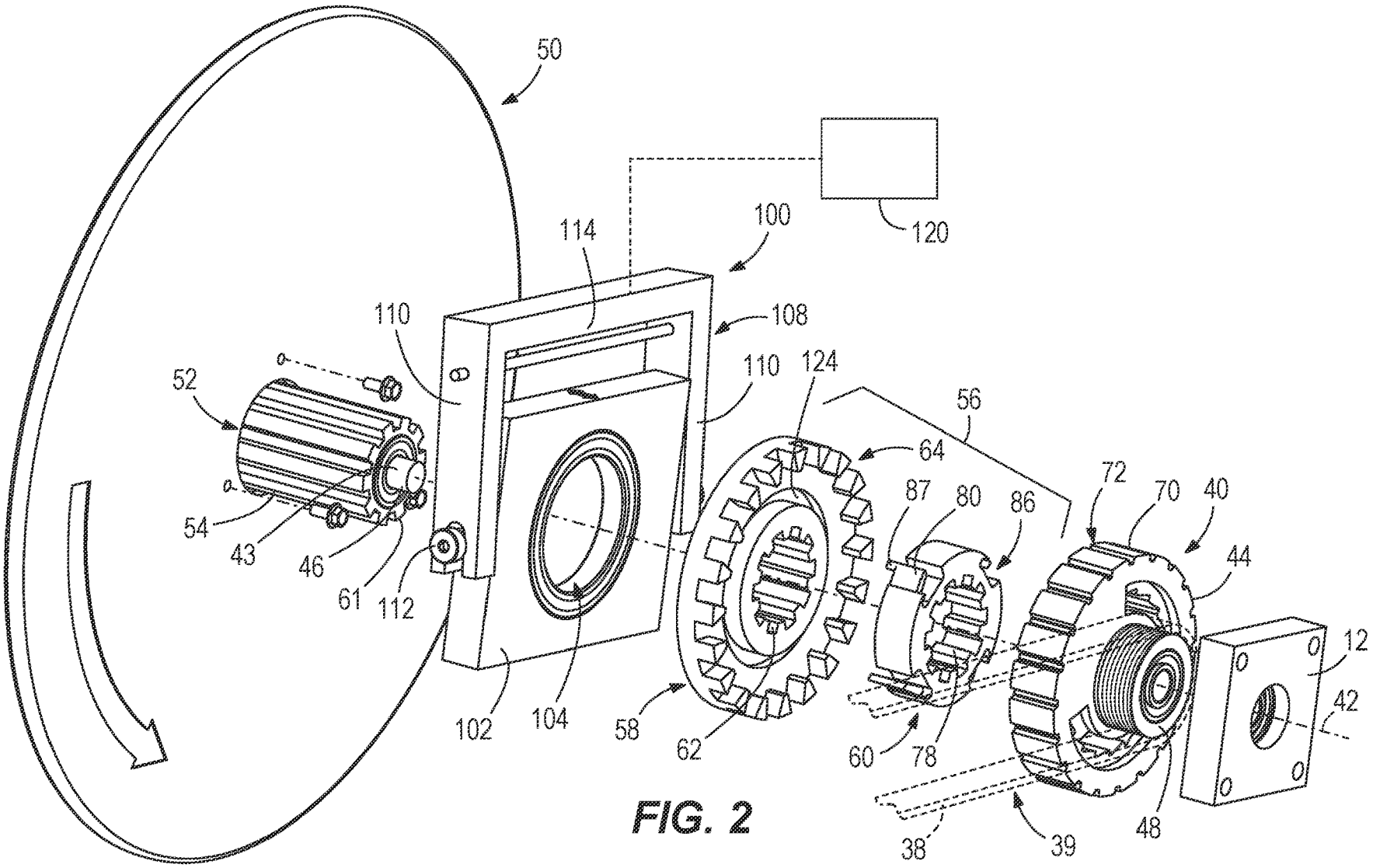
FIG. 2 is a front-side exploded view of the clutch mechanism, a clutch actuator, and the flywheel.

FIG. 1 depicts an exercise machine, which in this example is a stationary bike 10. The type and configuration of stationary bike is exemplary and the concepts of the present disclosure can be implemented with other types of stationary bikes and also in any other type of exercise machines having a flywheel. In the illustrated example, the stationary bike 10 has a stationary frame 12 comprised of a body frame 14, a base frame 16 that supports the body frame 14 relative to the ground, a seat post 18 supporting an adjustable seat 20, and a handlebar column 22 that supports handlebars 24. Optionally the stationary bike 10 can include a user input device, including a touchscreen 26 that is supported on the handlebar column 22 and manually operable by the user. Manual inputs to the touchscreen 26 are received by a controller 28, which has a processor and a memory, as is known in the art, for receiving the user inputs. The controller 28 is programmed to control one or more operational functions of the stationary bike 10 according to the user inputs and/or according to an exercise routine stored in the memory. The type and configuration of the controller 28 can vary and is a conventional item, other than certain programming related to the concepts of the present disclosure and particularly how the controller 28 is configured to control components of the stationary bike 10 to enact a change between the free-wheel and direct drive states, as is further described herein below.

The exercise bike 10 has a user input member, which in the illustrated example includes pedal crank arms 30 that support foot pedals 32. As conventional, the user performs an exercise motion on the stationary bike 10 by sitting on the adjustable seat 20 with his or her hands on the handlebars 24 and his or her feet on the foot pedals 32. The user pedals the foot pedals 32 in a forward pedaling motion shown at arrow 31, which forwardly rotates the pedal crank arms 30 and a corresponding drive wheel 34 about a first axis of rotation 36. A flexible connector 38 such as an endless belt or chain has a front portion 37 wrapped around the drive wheel 34 such that forward rotation of drive wheel 34 by pedaling causes commensurate forward rotation of the flexible connector 38. The flexible connector 38 has a rear portion 39 wrapped around a rotary input member 40, which in the illustrated example is a pulley wheel 44 that is rotatable about a second axis of rotation 42 extending parallel to the first axis of rotation 36. Thus, forward rotation of the foot pedals 32 causes forward rotation of the drive wheel 34, which in turn causes forward rotation of the flexible connector 38, which in turn causes forward rotation of the rotary input member 40 about the second axis of rotation 42.

Referring to FIGS. 2-5, a stationary shaft 46 extends along the second axis of rotation 42. The stationary shaft 46 has inner and outer ends 41, 43 supported on the stationary frame 12 by inner and outer bearings 45, 47, respectively. The pulley wheel 44 is located on the outer end 43 and has a pulley wheel stem 48 through which the outer end 43 of the stationary shaft 46 extends. Inner and outer bearings 49, 51 support the pulley wheel stem 48 on outer end 43 and facilitate rotation of the pulley wheel 44 about the stationary shaft 46. The noted rear portion 39 of the flexible connector 38 is wrapped around the pulley wheel stem 48 such that forward rotation of the flexible connector 38 causes forward rotation of the pulley wheel 44 about the stationary shaft 46, as described above. Optionally to facilitate manufacturing, the pulley wheel 44 can comprises an inner wheel 33 (see FIG. 3) that is nested in an outer wheel 35. The inner and outer wheels 33, 35 have non-circular outer and inner diameters, respectively, so that these components rotate together about the stationary shaft 46. In other examples, the pulley wheel 44 is a one-piece (i.e., monolithic) component.

A flywheel 50 is located on the inner end 41 of the stationary shaft 46. The flywheel 50 has a flywheel stem 52 through which the inner end 41 of the stationary shaft 46 extends. The flywheel stem 52 has axially-extending external splines 54. Inner and outer bearings 53, 55 support the flywheel stem 52 on the stationary shaft 46 and facilitate rotation of the flywheel 50 about the stationary shaft 46. A backing plate 57 is secured to the flywheel 50 by fasteners 59 and rotationally couples the flywheel stem 52 to the flywheel 50 via a splined connection.

Figure 4:
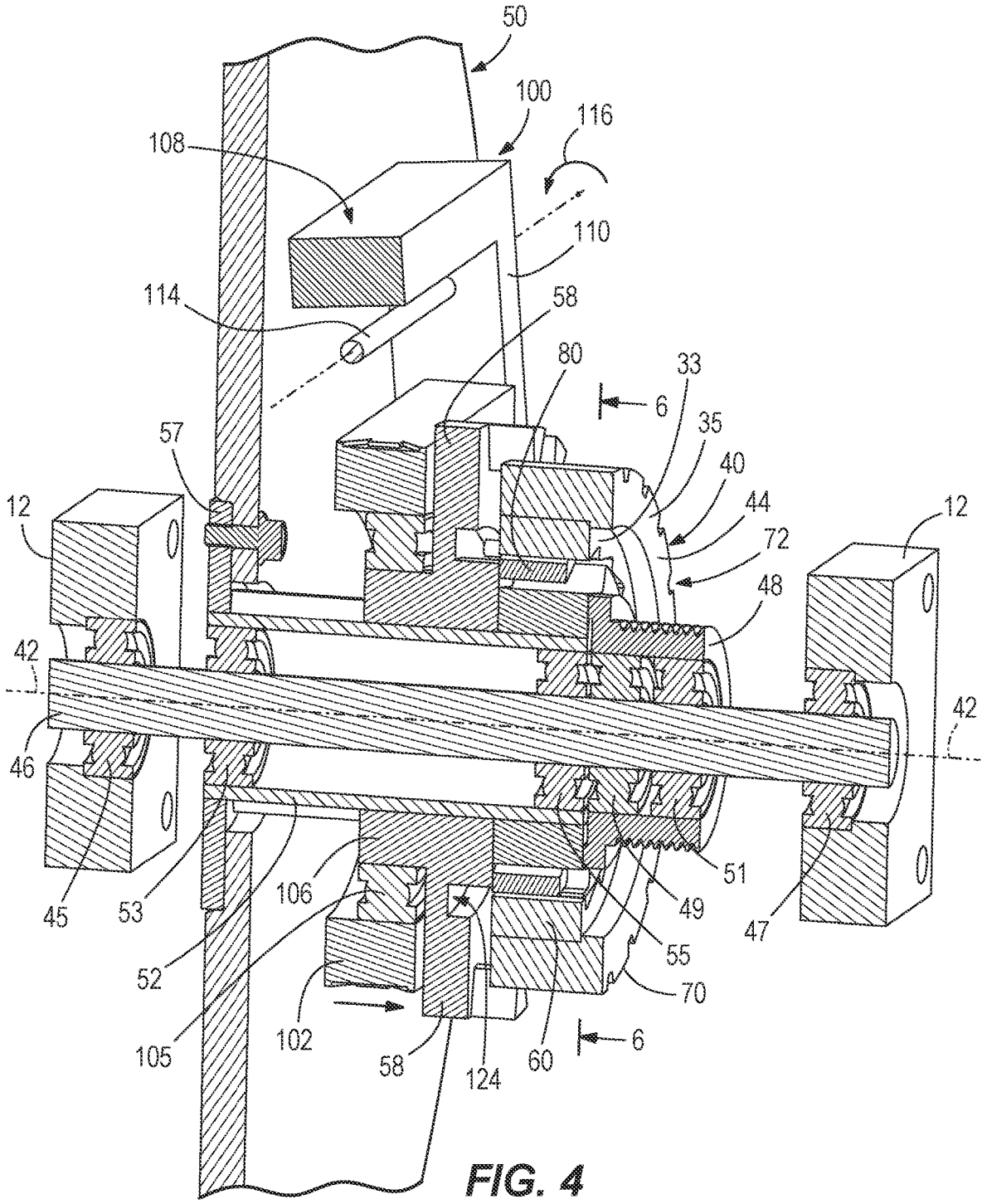
FIG. 4 is a side sectional view illustrating the clutch mechanism in a direct drive position.

A novel clutch mechanism 56 is located on the flywheel stem 52. The clutch mechanism 56 includes a clutch gear 58 and a locking hub 60. The clutch gear 58 has axially extending internal splines 62 that are meshed with the external splines 54 on the flywheel stem 52. As such, the clutch gear 58 is axially slide-able along the flywheel stem 52. The meshed, splined engagement between the flywheel stem 52 and clutch gear 58 cause the flywheel 50 and clutch gear 58 to rotate together about the stationary shaft 46 and about second axis of rotation 42. Clutch dogs 64 protrude from the outer face of the clutch gear 58, along its outer perimeter. The clutch dogs 64 have a triangular profile with a wide radially outer end and a narrow radially inner end. The pulley wheel 44 has corresponding clutch dogs 70 along its outer perimeter. The clutch dogs 70 are separated by axial slots 72 formed in the outer perimeter. As shown in FIG. 4, the narrow inner ends are received by the axial slots 72 when, in use, the clutch gear 58 is axially slid along the flywheel stem 52 into engagement with the pulley wheel 44, as will be further described herein below.

Figure 3:
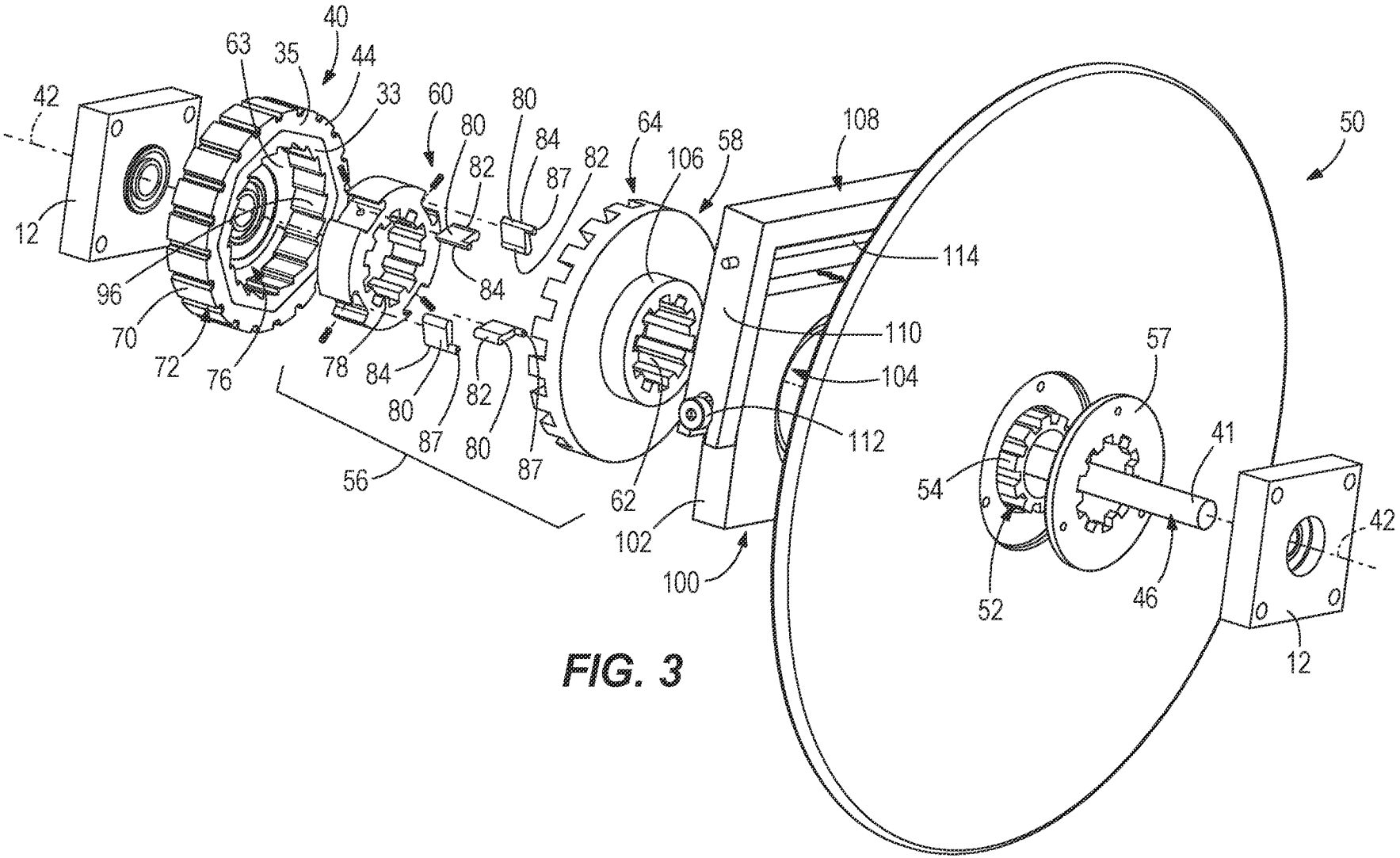
FIG. 3 is a rear-side exploded view of the clutch mechanism, the clutch actuator, and the flywheel.

Referring to FIG. 3, the locking hub 60 is nested in a cavity 76 in the rear surface of the pulley wheel 44. The locking hub 60 has axially-extending internal splines 78 that are meshed with the external splines 54 on the flywheel stem 52. The meshed, splined engagement between the flywheel stem 52 and locking hub 60 cause these components to rotate together about the stationary shaft 46 and about second axis of rotation 42.

It will thus be understood that flywheel 50, clutch gear 58 and locking hub 60 always rotate together about the stationary shaft 46 via the splined engagement of the external splines 54 with the internal splines 62, 78, respectively. The clutch gear 58 is axially slide-able along the flywheel stem 52 into and between the positions shown in FIGS. 4 and 5, as will be further described herein below. The locking hub 60 is nested in the pulley wheel 44 and remains at the outer end 43 of the stationary shaft 46 due to engagement between the outer end 61 (see FIG. 2) of the flywheel stem 52 and the inner surface 63 (see FIG. 3) of the cavity 76 in the pulley wheel 44.

Figure 12:
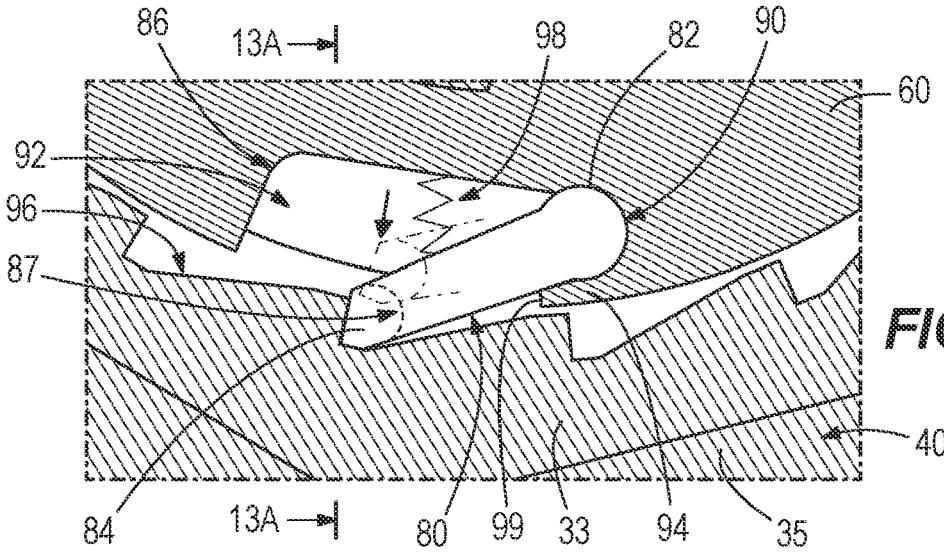
FIG. 12 is detail view taken in FIG. 11.

Four spring-biased pawls 80 are peripherally spaced apart around the outer perimeter of the locking hub 60. Referring to FIGS. 3, 7, 9, and 12, each pawl 80 has an elongated body with an inner end 82 that is pivotally attached to the locking hub 60 and an opposite, outer end 84. A stop finger 87 axially extends from the outer end 84, i.e., transversely relative to the elongated body. As shown by solid and dash-and-dot lines in FIG. 12, each pawl 80 is movable into and out of a corresponding pawl slot 86 formed in the outer perimeter of the locking hub 60. The pawl slot 86 has an inner end 90 and an outer end 92. The inner end 82 of the pawl 80 is located in the pawl slot 86 and is covered by a lip 94. The inner end 82 of the pawl 80 is pivotably coupled to the locking hub 60 by for example a pivot pin (not shown) that extends transversely through the inner end 82, i.e. transversely relative to the stationary shaft 46 and second axis of rotation 42, and into engagement with the locking hub 60. Thus the pawls 80 are pivotable into and between the positions shown in FIG. 12, including an extended position shown in solid lines wherein the outer end 84 extends out of a pawl slot 86 and a retracted position shown in dash-and-dot lines wherein the outer end 84 is completely or at least partially retracted towards or nested in the pawl slot 86. A spring 98 biases the pawl 80 towards the extended position. The spring 98 illustrated in the figures is a compression spring that biases the pawl 80 away from the inner surface of the pawl slot 86; however the spring 98 could alternately be a torsion spring disposed on the noted pivot pin of the pawl 80. As shown in FIG. 12, the outer end of the lip 94 provides a stop surface 99 that prevents over-rotation of the pawl 80, past the extended position shown in the figure.

The locking hub 60 is nested in the cavity 76 of the pulley wheel 44 such that the inner diameter of the pulley wheel 44 faces the outer perimeter of the locking hub 60. As mentioned above, the locking hub 60 is rotatably connected by spline connection to the flywheel 50 and thus rotates together with the flywheel 50 during all operational states of the clutch mechanism 56. The pawls 80 rotationally engage or disengage the locking hub 60 and pulley wheel 44 during different operational states of the clutch mechanism 56, as will be further described herein below. More specifically, the inner diameter of the pulley wheel 44 has a series of angular, stepped ratchet surfaces 96 (see FIG. 3) across which the pawls 80 ratchet in the noted freewheel state, thus permitting rotation of the flywheel 50 relative to the pulley wheel 44, and alternately with which the pawls 80 directly engage during the noted direct drive state, thus rotatably locking the flywheel 50 and pulley wheel 44, all as will be further described herein below.

Figure 5:
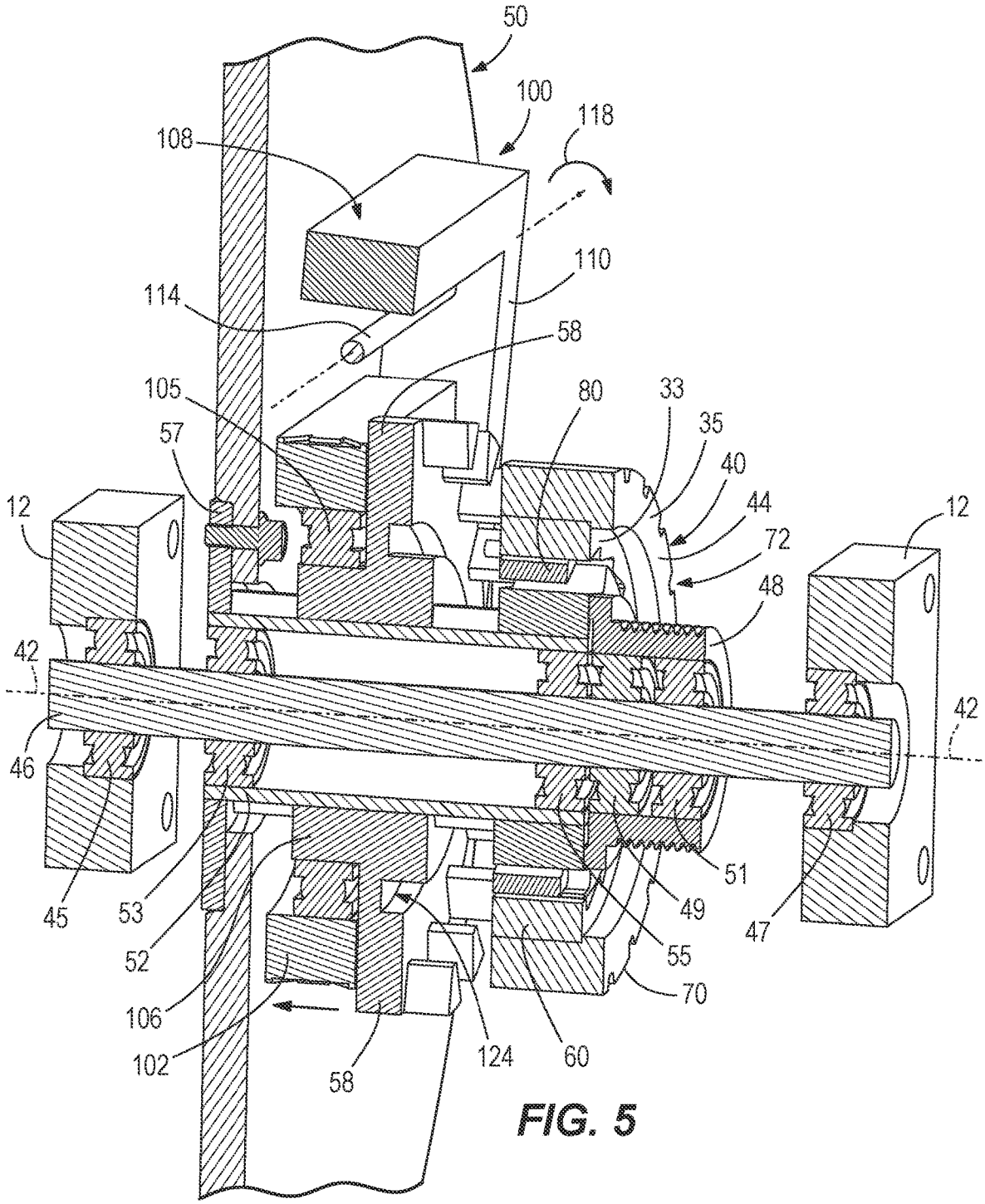
FIG. 5 is a view like FIG. 4, illustrating the clutch mechanism in a freewheel position.

Referring to FIGS. 2-5, a clutch actuator 100 is configured to shift the clutch mechanism 56 between the noted freewheel and direct drive states. The type and configuration of the clutch actuator 100 can vary. In the illustrated embodiment, the clutch actuator 100 comprises a clutch plate 102 disposed on the flywheel stem 52 between the flywheel 50 and the clutch gear 58. The clutch plate 102 has a central bore 104 through which the flywheel stem 52 extends. The clutch gear 58 has an inner clutch gear stem 106 that extends through the central bore 104. A bearing 105 supports the clutch plate 102 on the inner clutch gear stem 106 such that the clutch gear 58 is rotatable relative to the clutch plate 102. It will thus be recognized that the flywheel 50, clutch gear 58 and locking hub 60 are rotatable together relative to the clutch plate 102. The clutch plate 102 does not rotate. A fork 108 has opposing arms 110 that are pivotably coupled to opposite sides of the clutch plate 102 by pivot pins 112. The fork 108 is pivotably coupled to the stationary frame 12 by a pivot shaft 114. Referring to FIG. 4, pivoting of the fork 108 in a first direction 116 relative to the stationary frame 12, i.e., in one direction about the pivot shaft 114, axially pushes the clutch plate 102 outwardly along the flywheel stem 52, which in turn pushes the clutch gear 58 towards engagement with the pulley wheel 44 and locking hub 60. Referring to FIG. 5, pivoting the fork 108 in an opposite, second direction 118 relative to the stationary frame 12, i.e., in the opposite direction about the pivot shaft 114, pulls the clutch gear 58 away from the pulley wheel 44 and locking hub 60.

In the illustrated example, a conventional bi-directional electric motor 120 (see FIG. 2) is connected to the fork and configured to pivoting the fork 108 relative to the stationary frame 12. The electric motor 120 is operatively coupled to and controlled by the controller 28. In use the controller 28 outputs an electrical signal to the electric motor 120, which causes the electric motor 120. In use, the controller 28 is programmed to output an electric signal to the electric motor 120 based upon a user input and/or based upon an exercise program stored in the memory. The electric signals comprise commands that cause the electric motor 120 to pivot the fork 108 in the first or second directions. Bi-directional electric motors configured to operate based on a command from a controller are known in the art and thus are not further herein described.

It should be recognized that the illustrated clutch actuator 100 and electric motor 120 are exemplary. In other examples, the clutch mechanism 56 can be actuated by other means, including mechanical push-pull or pull-pull cables, gears, and/or the like, or hydraulic actuators, linear actuator, and/or any other means for causing movement of the clutch gear 58.

FIGS. 6-13B depict operational states of the stationary bike 10 and are described in sequence herein below.

Figure 6:
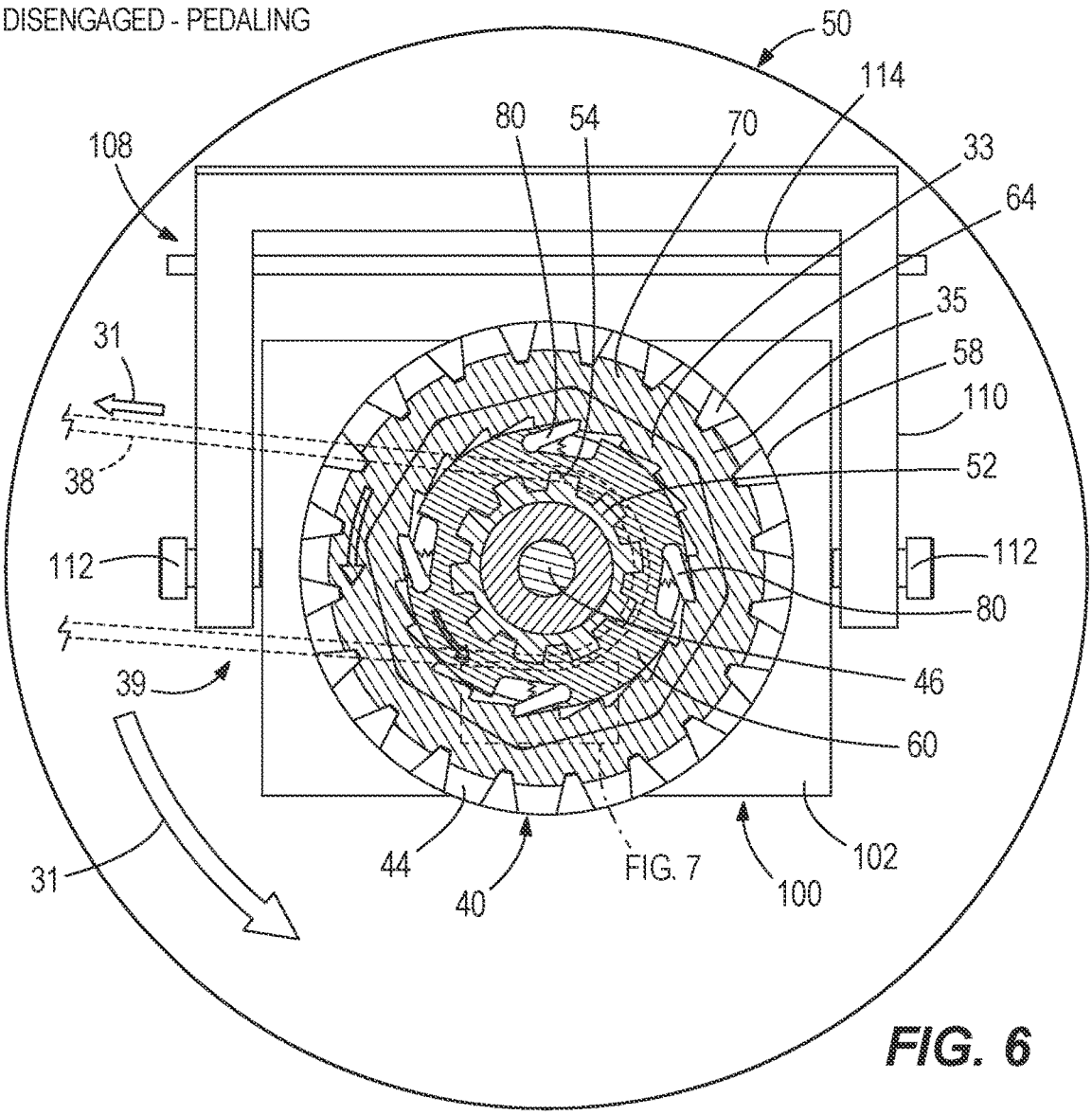
FIG. 6 illustrates forward rotation of the flywheel with the clutch mechanism in the freewheel position
Figure 7:
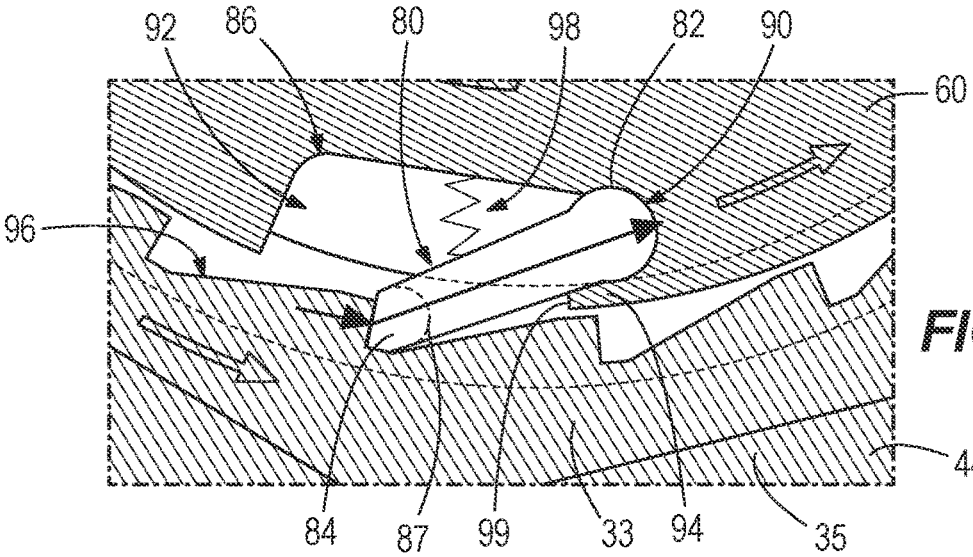
FIG. 7 is a detail view taken in FIG. 6.

FIGS. 5, 6 and 7 depict the stationary bike 10 in the noted freewheel state, wherein the clutch mechanism 56 is positioned as shown in FIG. 5. In this state, the controller 28 has sent a signal to the electric motor 120 to pivot the fork 108 in the second direction 118, which pulls the clutch gear 58 inwardly towards the flywheel 50, away from and out of engagement with the pulley wheel 44 and locking hub 60. The user begins the exercise motion of pedaling the food pedals 32, which as described above causes forward rotation of the drive wheel 34, which in turn causes forward rotation of the flexible connector 38, which in turn causes forward rotation of the rotary input member 40, herein the pulley wheel 44, about the second axis of rotation 42. The pawls 80 are normally biased outwardly by the springs 98. Forward rotation of the pulley wheel 44 brings the stepped ratchet surfaces 96 into engagement with the outer ends 84 of the pawls 80, as shown in FIG. 7, such that forward rotation of the pulley wheel 44 causes forward rotation of the locking hub 60. Forward rotation of the locking hub 60 causes forward rotation of the flywheel 50 via the noted splined connection between the locking hub 60 and the flywheel stem 52. As stated above the clutch gear 58 rotates along with the flywheel 50 via the splined connection between the clutch gear 58 and the flywheel stem 52.

Figure 8:
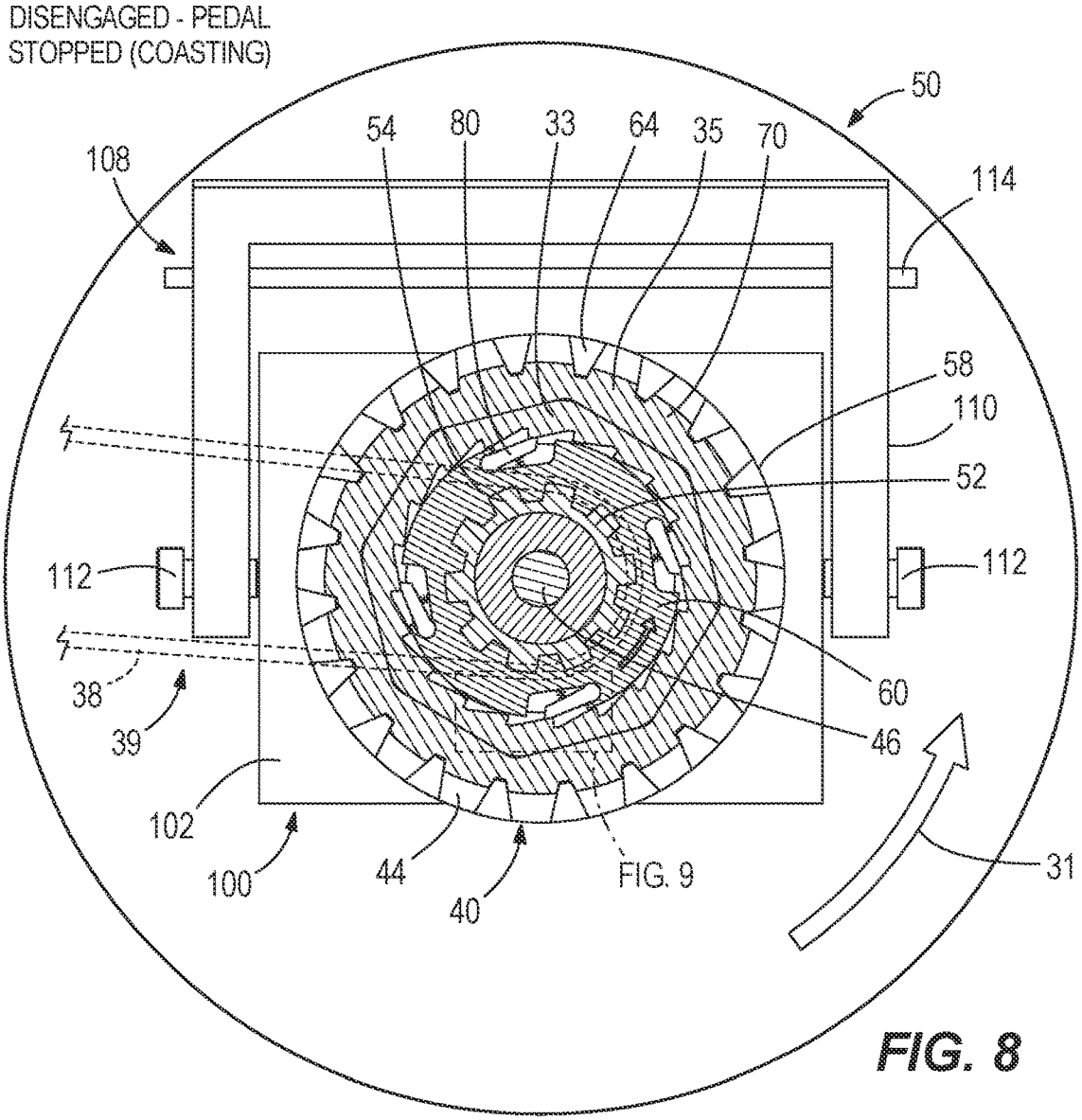
FIG. 8 illustrates how continued rotation of the flywheel is permitted upon cessation of the cycling exercise motion with the clutch mechanism in the free wheel position.
Figure 9:
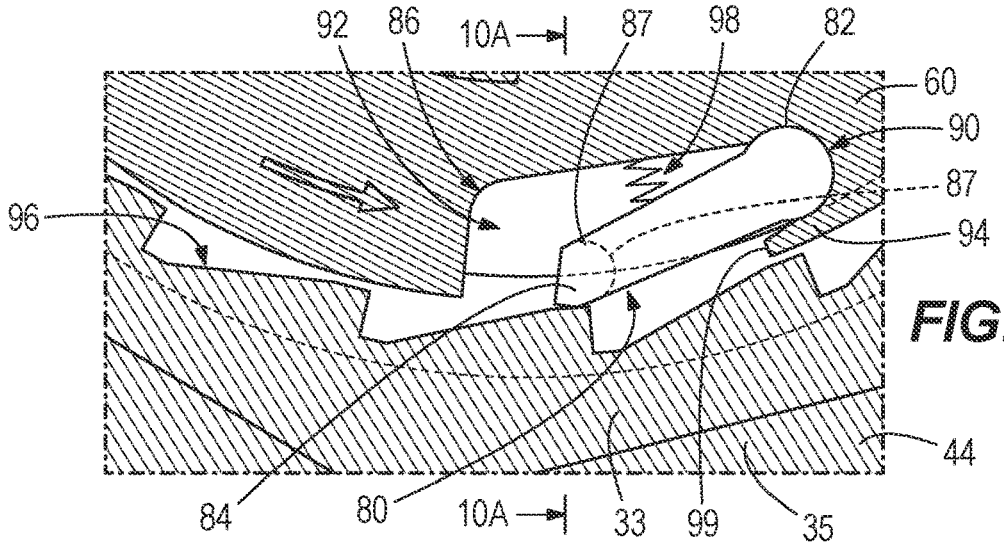
FIG. 9 is a detail view taken in FIG. 8.

FIGS. 8 and 9 depict the stationary bike 10 in the freewheel state when the user stops pedaling, i.e., wherein the user stops rotation of the foot pedals 32, which stops rotation of the drive wheel 34, the flexible connector 38 and the rotary input member 40, herein the pulley wheel 44. When these components stop rotating, the locking hub 60 is free to continue rotating under force of its own inertia, thus allowing the flywheel 50 to continue spinning and slowly decelerate. More specifically, when the pulley wheel 44 is stopped, the pawls 80 begin to ratchet across the stepped ratchet surfaces 96 as the locking hub 60 and flywheel 50 (and clutch gear 58) continue to rotate and slowly decelerate relative to the stationary pulley wheel 44. FIG. 9 shows continued rotation of the locking hub 60 at arrow 122 relative to the stationary pulley wheel 44 and also shows the pawl 80 travelling over the peak of the stepped ratchet surface 96, which travel is permitted by compression of the spring 98. When the pawl 80 passes over the peak of one stepped ratchet surface 96, the spring 98 biases the pawl 80 radially outwardly into engagement with the next stepped ratchet surface 96, and so on.

Figure 11:
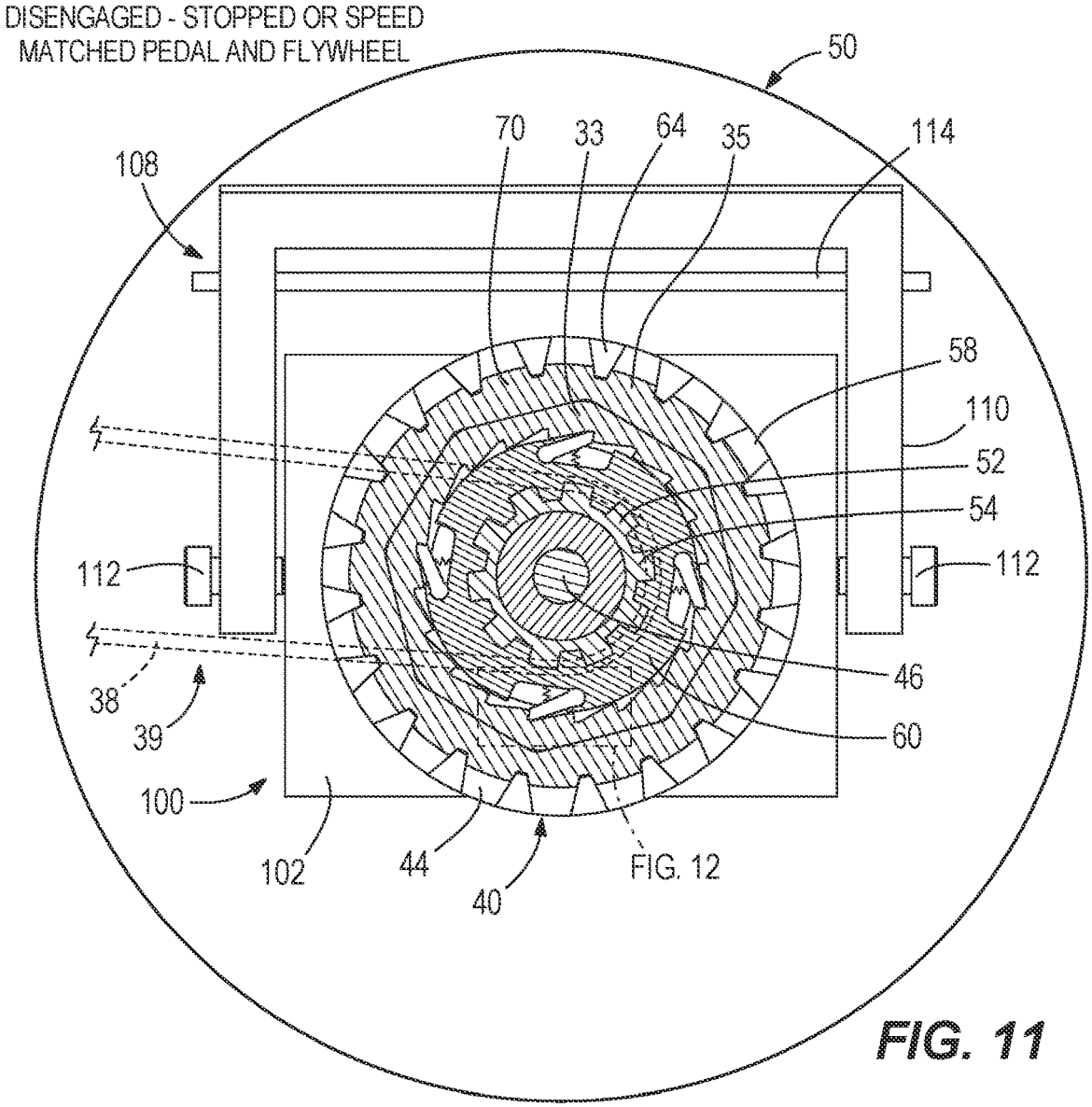
FIG. 11 illustrates engagement of the clutch mechanism when the rotary input member of the clutch mechanism is in synchronization with rotation of the flywheel.

FIGS. 4, 11 and 12 depict the stationary bike 10 in the noted direct drive state, wherein the clutch mechanism 56 is positioned as shown in FIG. 4. In this state, the controller 28 has sent a signal to the electric motor 120 to pivot the fork 108 in the first direction 116, which pushes the clutch gear 58 outwardly away from the flywheel 50, towards and into engagement with the pulley wheel 44 and locking hub 60. In this state, the clutch dogs 64 of the clutch gear 58 are brought into the slots 72 of the pulley wheel 44 so that the clutch dogs 64 of the clutch gear 58 are meshed with the clutch dogs 70 of the pulley wheel 44. This rotationally locks the clutch gear 58 to the pulley wheel 44, such that forward rotation of the pulley wheel 44 causes forward rotation of the clutch gear 58 and the flywheel 50 about the stationary shaft 46 and such that stopping forward rotation of the pulley wheel 44 stops rotation of the clutch gear 58 and the flywheel 50. With the clutch mechanism 56 in this state, the user begins the exercise motion of pedaling the food pedals 32, which as described above causes forward rotation of the drive wheel 34, which in turn causes forward rotation of the flexible connector 38, which in turn causes forward rotation of the rotary input member 40, herein the pulley wheel 44, about the second axis of rotation 42. Forward rotation of the pulley wheel causes forward rotation of the clutch gear 58 via the noted meshed engagement between the clutch dogs 64 and clutch dogs 70. Forward rotation of the clutch gear 58 causes forward rotation of the pulley wheel 44. If the user stops pedaling, the noted forward rotation of the pulley wheel 44 will stop, which in turn stops rotation of the flywheel 50 via the meshed engagement between the clutch dogs 64 and clutch dogs 70.

Figure 10A:
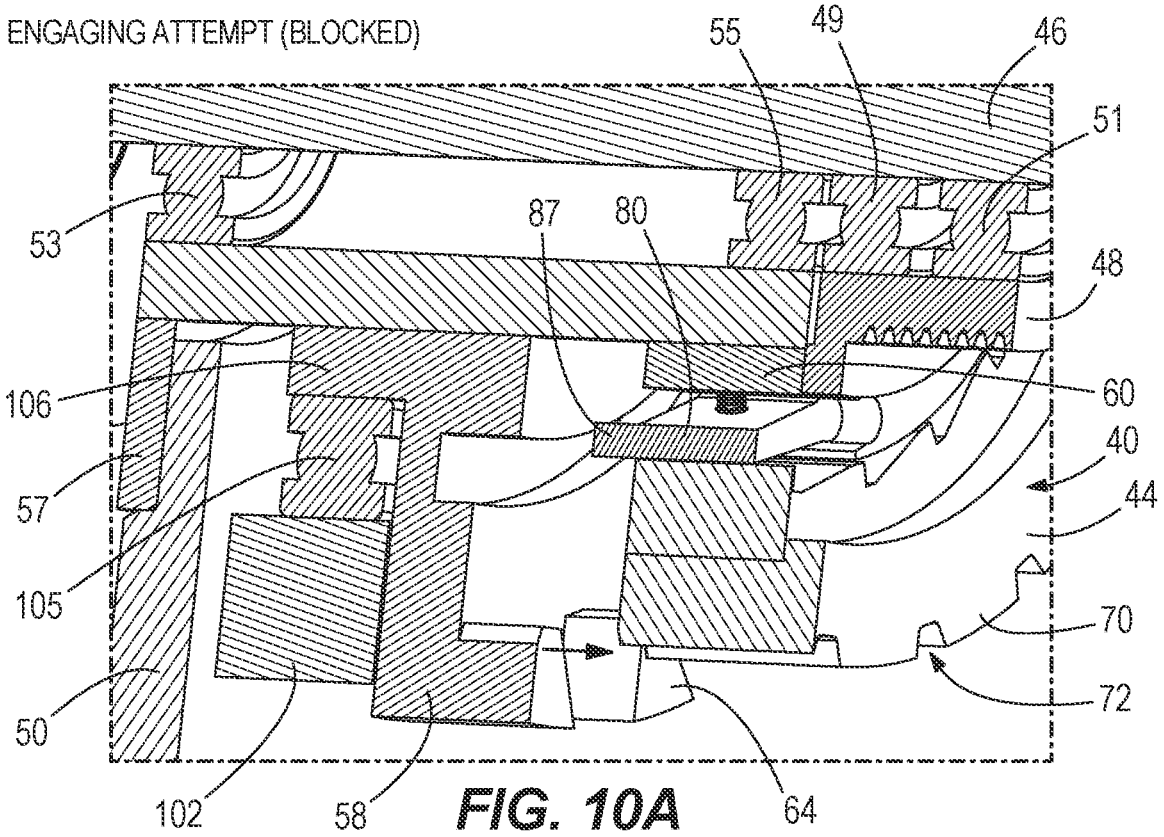
FIGS. 10A and 10B illustrate how shifting of the clutch mechanism from the freewheel position to the direct drive position is prevented when the rotary input member of the clutch mechanism is out of synchronization with rotation of the flywheel.
Figure 10B:
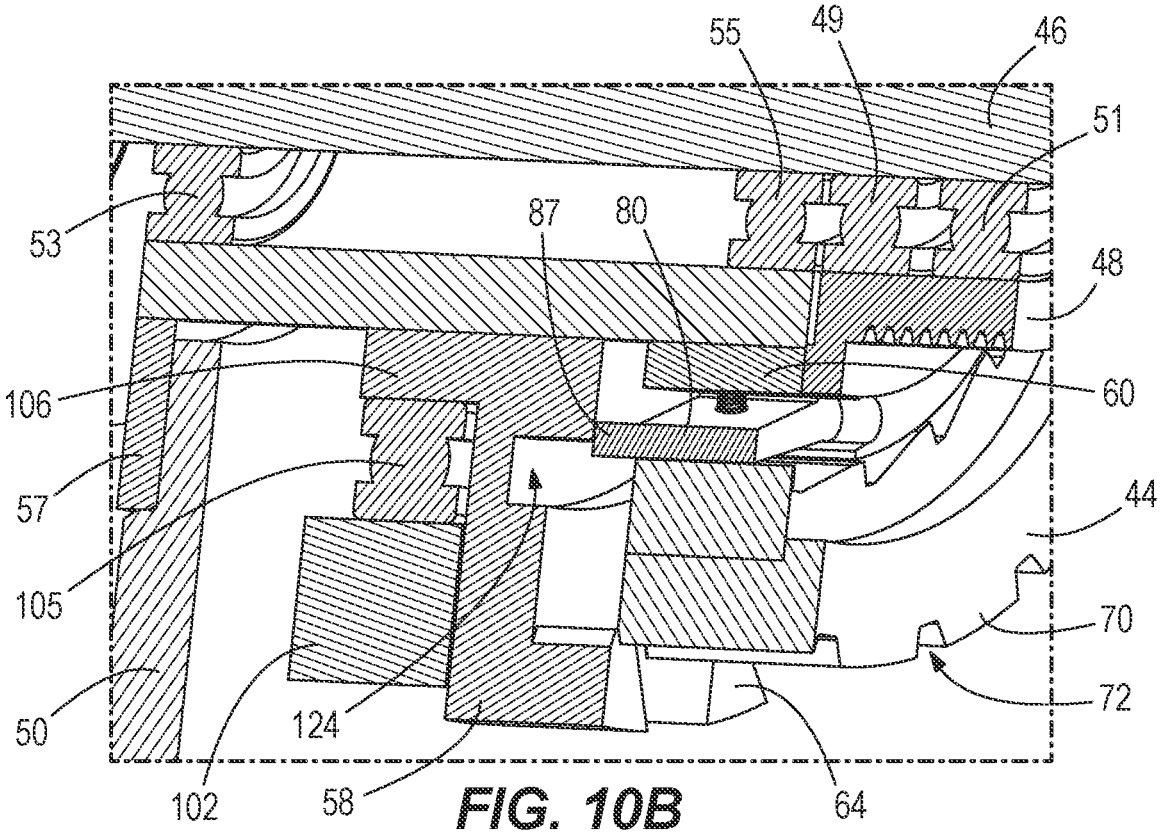

The clutch mechanism 56 is advantageously configured to prevent a gear change from the freewheel state to the direct drive state unless the speed of rotation of the pulley wheel 44 substantially matches the speed of rotation of the flywheel 50. This speed-matching or synchronization requirement advantageously prevents an accidental gear change during use of the exercise bike 10 in the freewheel state, which otherwise could cause a shock to the clutch mechanism 56 and/or potentially damage the clutch mechanism 56 and/or surprise the user. FIGS. 10A-10B illustrate the clutch mechanism 56 in a state where the speed of rotation of the flywheel 50 does not match the speed of rotation of the pulley wheel 44 and thus an engagement of the clutch gear 58 with the pulley wheel 44 to enact the direct drive state is not permitted. More specifically, when the speed of rotation of the flywheel 50 does not match or is not synchronized with the speed of rotation of the pulley wheel 44, there will be relative rotation occurring between the locking gear 60 and the pulley wheel 44. The locking gear 60 rotates with the flywheel 50 via the noted splined connection. The pulley wheel 44 rotates on the stationary shaft 46. When the rotational speeds of these two components are different, the pawls 80 will be ratcheting across the stepped ratchet surfaces 96, as described herein above. Each pawl 80 has the noted stop finger 87, which protrudes axially inwardly towards the outer face of the clutch gear 58. When ratcheting, the stop fingers 87 of the pawls 80 engage with the outer face of the clutch gear 58 and thus prevent movement of the clutch gear 58 axially outwardly into engagement with the pulley wheel 44 via meshing of the clutch dogs 64, 70. The stop fingers 87 block axially outward movement of the clutch gear 58 and thus prevent engagement of the clutch dogs 64, 70. This maintains the clutch mechanism 56 in the freewheel state when the speeds of the flywheel 50 and pulley wheel 44 are not synchronized.

Figure 13A:
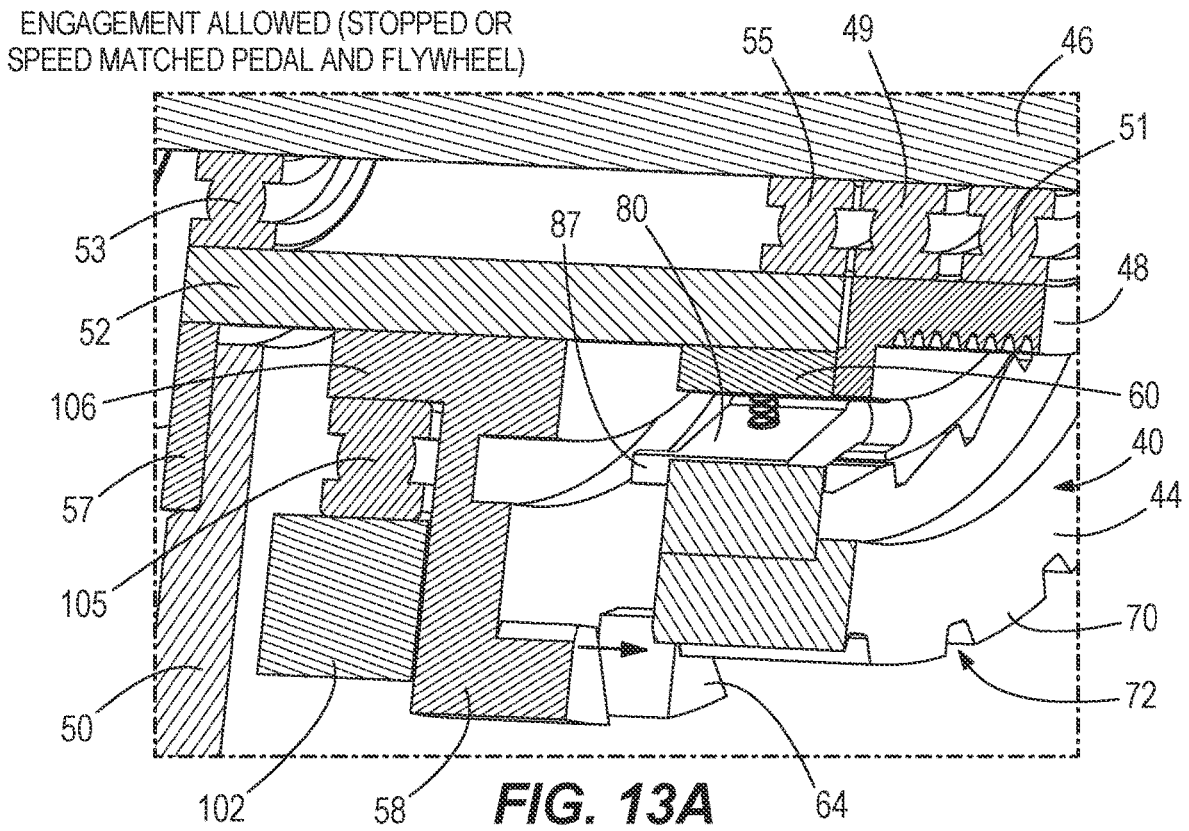
FIGS. 13A and 13B illustrate how shifting of the clutch mechanism from the freewheel position to the direct drive position is permitted when the rotary input member of the clutch mechanism is synchronized with rotation of the flywheel.
Figure 13B:
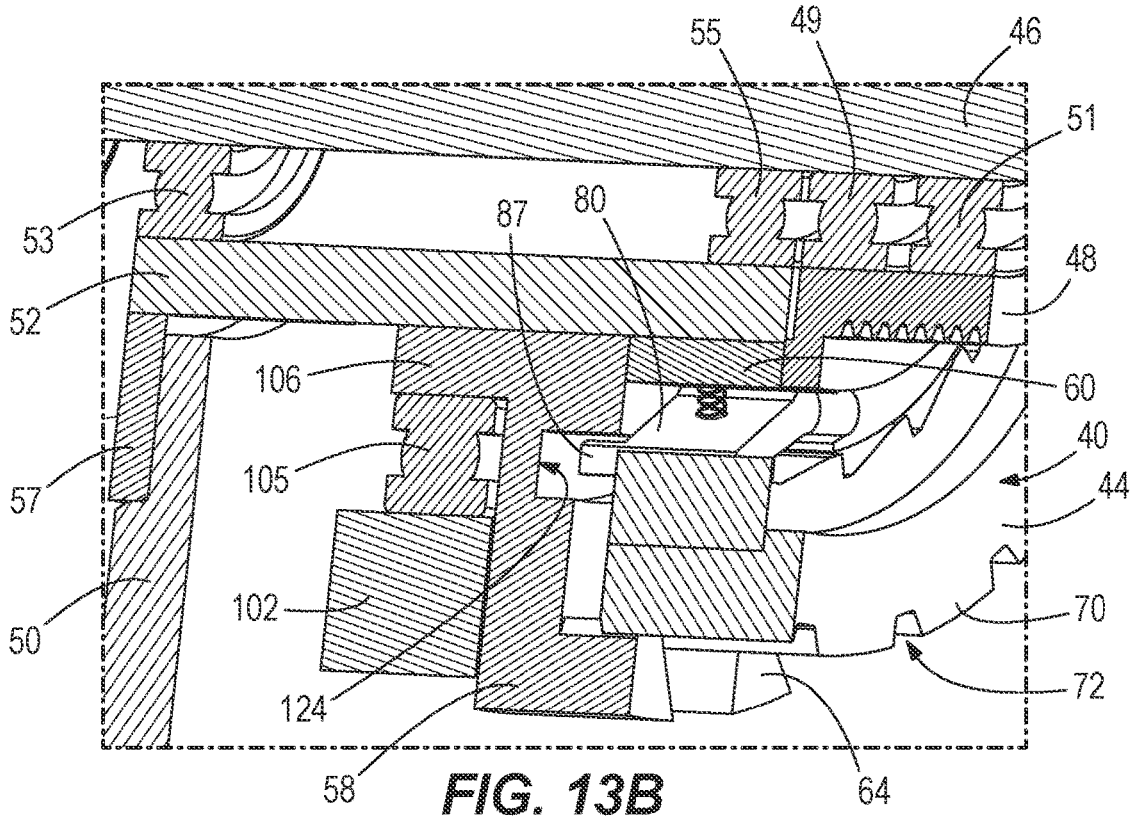

FIGS. 13A and 13B illustrate the clutch mechanism 56 in a state where the speed of rotation of the flywheel 50 substantially matches the speed of rotation of the pulley wheel 44 and thus an engagement of the clutch gear 58 with the pulley wheel 44 to enact the direct drive state is permitted. More specifically, when the speed of rotation of the flywheel 50 matches or is synchronized with the speed of rotation of the pulley wheel 44, there will be no relative rotation occurring between the locking gear 60 and the pulley wheel 44. These components will have a rotational speed that is synchronized. When the rotational speeds of these two components are synchronized, the pawls 80 will be biased radially outwardly by the spring 98 into engagement with the stepped ratchet surfaces 96, as described herein above. In this position, the stop finger 87 on the pawls 80 are brought into radially alignment with an annular channel 124 in the outer surface of the clutch gear 58. Alignment of the stop fingers 87 with the annular channel 124 permits axially outward movement of the clutch gear 58 into engagement with the pulley wheel 44 via meshing of the clutch dogs 64, 70. The stop fingers 87 protrude into the annular channel 124, as shown in FIGS. 13A and 13B, which facilitates the need outward movement of the clutch gear 58 to engage the clutch dogs 64, 70. This advantageously permits change of the clutch mechanism 56 from the freewheel state to the direct drive state only when the speeds of the flywheel 50 and pulley wheel 44 are synchronized. In other words, the clutch mechanism 56 is configured to permit switching from the freewheel state to the direct drive state only when both the foot pedals 32 and flywheel 50 are at rest or when the user is actively pedaling the foot pedals 32 at a speed that is synchronized with the speed of rotation of the flywheel 50. This advantageously prevents an unexpected or unwanted gear switch from occurring, thus protecting the exercise bike 10 from damage and preventing a shock to the user.

It will thus be recognized that the present disclosure provides embodiments of an exercise machine comprising a flywheel; a rotary input member; a user input member for performing an exercise motion, which causes rotation of the rotary input member; and a clutch mechanism positionable in a freewheel position in which rotation of the rotary input member causes rotation of the flywheel and wherein thereafter ceasing rotation of the rotary input member permits continued rotation of the flywheel, and alternately positionable in a direct drive position in which rotation of the rotary input member causes rotation of the flywheel and wherein thereafter ceasing rotation of the rotary input member prevents continued rotation of the flywheel. Advantageously the clutch mechanism prevents movement from the freewheel position to the direct drive position when rotation of the rotary input member is out of synchronization with rotation of the flywheel. FIG. 4 depicts the clutch mechanism 56 in the direct drive state, wherein rotation of the foot pedals 32 causes rotation of the flywheel 50 and wherein ceasing rotation of the foot pedals 32 ceases rotation of the flywheel 50. FIG. 5 depicts the clutch mechanism in the freewheel state, wherein rotation of the foot pedals 32 causes rotation of the flywheel 50 and wherein ceasing rotation of the foot pedals 32 permits continued rotation of the flywheel 50 based upon its own inertia. FIGS. 6 and 7 depict the exercise bike 10 in the freewheel state when the foot pedals 32 are being forwardly rotated by the user, which causes forward rotation of the flywheel 50. FIGS. 8 and 9 depict the exercise bike 10 in the freewheel state once rotation of the foot pedals 32 has been stopped, which permits continued rotation of the flywheel 50. FIGS. 10A and 10B illustrated how the clutch mechanism 56 prevents a change from the freewheel state to the direct drive state when the speed of rotation of the foot pedals 32 is not synchronized with the speed of rotation of the flywheel 50. In this state, the stop fingers 87 on the pawls 80 do not remain aligned with the annular channel 124 in the clutch gear 58 and thus engage with the outer surface of the clutch gear 58 and prevent axially outward movement of the clutch gear 58 into engagement with the pulley wheel 44. FIGS. 11 and 12 depict the exercise bike 10 either when the speeds of rotation of the foot pedals 32 and flywheel 50 are synchronized, including but not limited to when both components are at rest, which permits the spring 98 to bias the pawls 80 outwardly into the position shown. As shown in FIGS. 13A and 13B, this permits the clutch actuator 100 to move the clutch gear 58 outwardly into meshed engagement with the pulley wheel 44, as the stop fingers 87 protrude into the annular channel 124, thus engaging the direct drive state wherein the foot pedals 32 and flywheel 50 are rotationally locked together.

As used herein, "about," "approximately," "substantially," and "significantly" will be understood by persons of ordinary skill in the art and will vary to some extent on the context in which they are used. If there are uses of these terms which are not clear to persons of ordinary skill in the art given the context in which they are used, "about" and "approximately" will mean plus or minus <10% of the particular term and "substantially" and "significantly" will mean plus or minus >10% of the particular term.

This written description uses examples to disclose the invention, including the best state, and also to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. An exercise machine comprising:

a flywheel;

a rotary input member;

a user input member for performing an exercise motion, which causes rotation of the rotary input member; and a clutch mechanism that is positionable in a direct drive position in which the rotary input member is coupled to the flywheel via a meshed engagement so that rotation of the rotary input member causes rotation of the flywheel and so that thereafter ceasing rotation of the rotary input member prevents continued rotation of the flywheel, and further wherein the clutch mechanism is alternately positionable in a freewheel position in which the rotary input member is coupled to the flywheel so that ceasing rotation of the rotary input member permits continued rotation of the flywheel, wherein the clutch mechanism prevents movement of the clutch mechanism from the freewheel position to the direct drive position when a speed of rotation of the rotary input member is different than a speed of rotation of the flywheel.

2. The exercise machine according to claim 1, wherein the flywheel and the rotary input member rotate about an axis of rotation.

3. The exercise machine according to claim 2, wherein the rotary input member comprises a pulley wheel.

4. The exercise machine according to claim 3, wherein the clutch mechanism comprises a clutch gear that rotates with the flywheel, wherein positioning the clutch mechanism in the direct drive position moves the clutch gear into the meshed engagement with the pulley wheel so that the clutch gear and the pulley wheel rotate together about the axis of rotation, and wherein positioning the clutch mechanism in the freewheel position moves the clutch gear out of engagement with the pulley wheel so that the clutch gear and the pulley wheel are separately rotatable about the axis of rotation.

5. The exercise machine according to claim 4, wherein the clutch gear comprises dogs that engage with corresponding dogs of the pulley wheel when the clutch mechanism is in the direct drive position.

6. The exercise machine according to claim 4, wherein the clutch mechanism further comprises a locking hub that rotates with the pulley wheel about the axis of rotation.

7. The exercise machine according to claim 6, wherein the locking hub and the clutch gear engage each other and thereby prevent movement of the clutch mechanism from the freewheel position to the direct drive position when the speed of rotation of the rotary input member is different than the speed of rotation of the flywheel.

8. The exercise machine according to claim 1, wherein the flywheel and the clutch mechanism rotate together about an axis of rotation and wherein the rotary input member also rotates about the axis of rotation.

9. The exercise machine according to claim 8, wherein the clutch mechanism comprises a clutch gear that is axially movable out of engagement with the rotary input member when the clutch mechanism is in the freewheel position and into engagement with the rotary input member when the clutch mechanism is in the direct drive position.

10. The exercise machine according to claim 9, wherein the clutch mechanism further comprises a locking hub that prevents movement of the clutch gear into engagement with the rotary input member when the speed of rotation of the rotary input member is different than the speed of rotation of the flywheel.

11. The exercise machine according to claim 10, further comprising a stationary shaft extending along the axis of rotation, wherein the flywheel, the clutch mechanism, and the rotary input member each are rotatable about the stationary shaft.

12. The exercise machine according to claim 1, further comprising an actuator that moves the clutch mechanism into and out of the freewheel position and the direct drive position.

13. The exercise machine according to claim 12, wherein the actuator is manually operable by a user performing the exercise motion.

14. The exercise machine according to claim 13, further comprising a stationary frame, wherein the actuator is pivotably coupled to the stationary frame and moveable into a disengaged position corresponding to the freewheel position and alternately into an engaged position corresponding to the direct drive position.

15. The exercise machine according to claim 1, wherein the user input member comprises a foot pedal.

16. The exercise machine according to claim 15, which comprises a stationary bike.

17. An exercise machine comprising:

a flywheel and a rotary input member that comprises a pulley wheel, wherein the flywheel and the rotary input member rotate about an axis of rotation;

a user input member for performing an exercise motion, which causes rotation of the rotary input member; and a clutch mechanism positionable in a freewheel position in which rotation of the rotary input member causes rotation of the flywheel and wherein thereafter ceasing rotation of the rotary input member permits continued rotation of the flywheel, and alternately positionable in a direct drive position in which rotation of the rotary input member causes rotation of the flywheel and wherein thereafter ceasing rotation of the rotary input member prevents continued rotation of the flywheel, wherein the clutch mechanism prevents movement of the clutch mechanism from the freewheel position to the direct drive position when rotation of the rotary input member is out of synchronization with rotation of the flywheel, wherein the clutch mechanism comprises a clutch gear that rotates with the flywheel, wherein positioning the clutch mechanism in the direct drive position moves the clutch gear into engagement with the pulley wheel so that the clutch gear and the pulley wheel rotate together about the axis of rotation, and wherein positioning the clutch mechanism in the freewheel position moves the clutch gear out of engagement with the pulley wheel so that the clutch gear and the pulley wheel are separately rotatable about the axis of rotation, wherein the clutch mechanism further comprises a locking hub that rotates with the pulley wheel about the axis of rotation, and wherein the locking hub comprises at least one pawl, wherein the pawl is configured to ratchets along the pulley wheel when the clutch mechanism is in the freewheel position, thus permitting relative rotation between the locking hub and the pulley wheel.

18. The exercise machine according to claim 17, wherein the at least one pawl is biased into engagement with the pulley wheel when a speed of rotation of the rotary input member is substantially the same as a speed of rotation of the flywheel.

19. The exercise machine according to claim 18, wherein the at least one pawl is one of a plurality of pawls disposed on an outer perimeter of the locking hub.

20. The exercise machine according to claim 19, wherein the locking hub is nested in the pulley wheel and wherein the plurality of pawls engages with a ratchet surface on an inner diameter of the pulley wheel when the clutch mechanism is in the direct drive position.

21. An exercise machine comprising:

a flywheel;

a rotary input member comprising a pulley wheel;

a user input member for performing an exercise motion, which causes rotation of the rotary input member; and a clutch mechanism that is positionable in a freewheel position in which rotation of the rotary input member causes rotation of the flywheel and thereafter ceasing rotation of the rotary input member permits continued rotation of the flywheel, and alternately that is positionable in a direct drive position in which rotation of the rotary input member causes rotation of the flywheel and thereafter ceasing rotation of the rotary input member prevents continued rotation of the flywheel, wherein the clutch mechanism comprises a clutch gear that rotates with the flywheel, wherein positioning the clutch mechanism in the direct drive position moves the clutch gear into engagement with the pulley wheel so that the clutch gear and the pulley wheel are rotationally locked relative to each other, and further wherein positioning the clutch mechanism in the freewheel position moves the clutch gear out of engagement with the pulley wheel so that the clutch gear and the pulley wheel are separately rotatable, and wherein, when a speed of rotation of the rotary input member is different than a speed of rotation of the flywheel, the clutch mechanism prevents movement of the clutch gear into engagement with the pulley wheel to move the clutch mechanism from the freewheel position to the direct drive position.

22. The exercise machine according to claim 21, wherein the clutch gear comprises dogs that engage with corresponding dogs of the pulley wheel when the clutch mechanism is in the direct drive position.

23. The exercise machine according to claim 21, wherein the clutch mechanism further comprises a locking hub that rotates with the pulley wheel about an axis of rotation.

* * * * *